US010708695B2

(12) United States Patent
Wu et al.

(10) Patent No.: US 10,708,695 B2
(45) Date of Patent: Jul. 7, 2020

(54) VIBRATION MEMBRANE

(71) Applicant: AAC Technologies Pte, Ltd., Singapore (SG)

(72) Inventors: Meiwei Wu, Shenzhen (CN); Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 389 days.

(21) Appl. No.: 15/856,931

(22) Filed: Dec. 28, 2017

(65) Prior Publication Data

US 2018/0367915 A1 Dec. 20, 2018

(30) Foreign Application Priority Data

Jun. 20, 2017 (CN) ..... 2017 2 0722797 U

(51) Int. Cl.

| | |
|---|---|
| ***H04R 7/18*** | (2006.01) |
| ***H04R 7/12*** | (2006.01) |
| ***G10K 13/00*** | (2006.01) |
| ***H04R 7/20*** | (2006.01) |
| ***H04R 7/04*** | (2006.01) |

(52) U.S. Cl.

CPC ..... *H04R 7/18* (2013.01); *G10K 13/00* (2013.01); *H04R 7/04* (2013.01); *H04R 7/127* (2013.01); *H04R 7/20* (2013.01); *H04R 2207/021* (2013.01); *H04R 2307/207* (2013.01)

(58) Field of Classification Search

CPC ..... H04R 7/18; H04R 2207/021; H04R 2307/207; H04R 7/127; H04R 7/06; H04R 7/04; H04R 7/20; G10K 13/00

See application file for complete search history.

(56) References Cited

U.S. PATENT DOCUMENTS

| | | | | |
|---|---|---|---|---|
| 9,668,058 | B2 * | 5/2017 | Matsumura | H04R 7/18 |
| 10,499,157 | B2 * | 12/2019 | Wu | H04R 7/127 |
| 2016/0227324 | A1 * | 8/2016 | Cai | H04R 7/14 |

FOREIGN PATENT DOCUMENTS

| | | | | |
|---|---|---|---|---|
| EP | 2227036 | A2 * | 9/2010 | H04R 7/20 |
| GB | 2574124 | A * | 11/2019 | B29C 45/0062 |
| KR | 101454324 | B1 * | 10/2014 | |
| WO | WO-2007119709 | A1 * | 10/2007 | H04R 7/20 |
| WO | WO-2009107192 | A1 * | 9/2009 | H04R 9/045 |
| WO | WO-2018035720 | A1 * | 3/2018 | H04R 7/04 |

* cited by examiner

*Primary Examiner* — Forrest M Phillips

(74) *Attorney, Agent, or Firm* — IPro, PLLC; Na Xu

(57) ABSTRACT

A vibration membrane is disclosed. The vibration membrane includes a central dome part and a suspension part surrounding the dome part. The suspension part includes a pair of long-axis parts parallel to a long axis of the vibration membrane, a pair of short-axis parts parallel to a short axis of the vibration membrane, and a number of corner parts connecting the long-axis parts with the short-axis parts. The suspension part further includes first reinforcing parts located on the corner parts and second reinforcing parts located on the long-axis parts. Each of the second reinforcing part has a first master extension part and a first slave extension part crossing with the first master extension part. By virtue of the configuration, the strength of the vibration membrane is improved.

7 Claims, 3 Drawing Sheets

VIBRATION MEMBRANE

CROSS-REFERENCE TO RELATED APPLICATIONS

This application claims the priority benefit of Chinese Patent Application Ser. No. 201720722797.5 filed on Jun. 20, 2017, the entire content of which is incorporated herein by reference.

FIELD OF THE PRESENT DISCLOSURE

The present disclosure relates to electro-acoustic transducers, more particularly to a vibration membrane of a speaker.

DESCRIPTION OF RELATED ART

With the rapid development of the electronic information technology, an increasing number of sounding devices are applied in all kinds of electronic products, especially in widely used mobile communication equipment. People not only pay attention to the miniaturized size and multi-function, but also expect such equipment have high-quality and distortion-free voice. As the vibration membrane is the core component of the sounding device, its design affects the behaviors of acoustic devices directly.

The traditional membrane comprises the central dome part and the suspension part encircling the dome part, and the suspension part is a structure of a single pattern. However, due to its insufficient strength and even lower strength at the corner of the suspension part, such membranes tend to collapse.

Therefore it is necessary to provide an improved vibration membrane for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
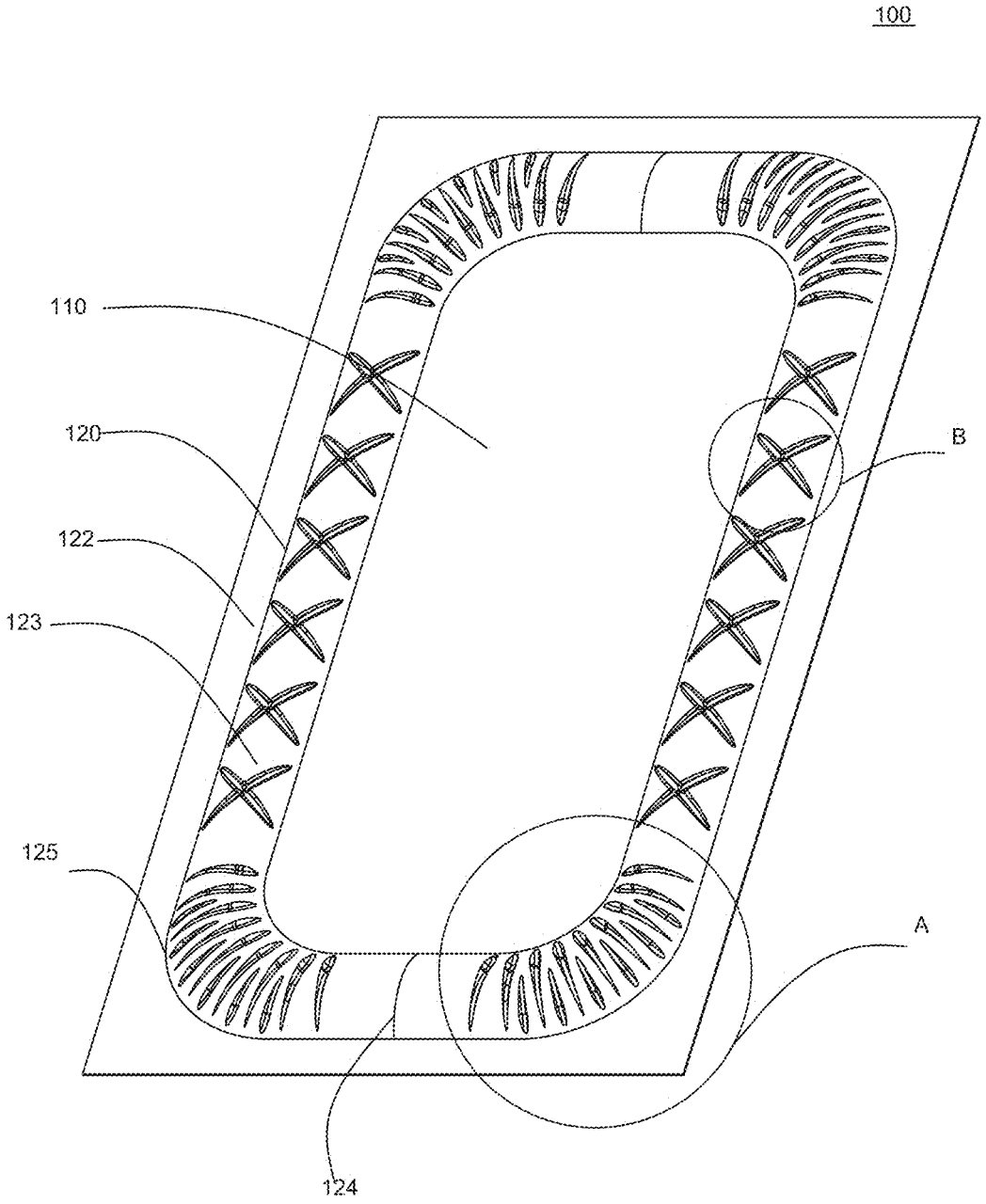
FIG. 1 is an isometric view of a vibration membrane in accordance with an exemplary embodiment of the present disclosure.
Figure 2:
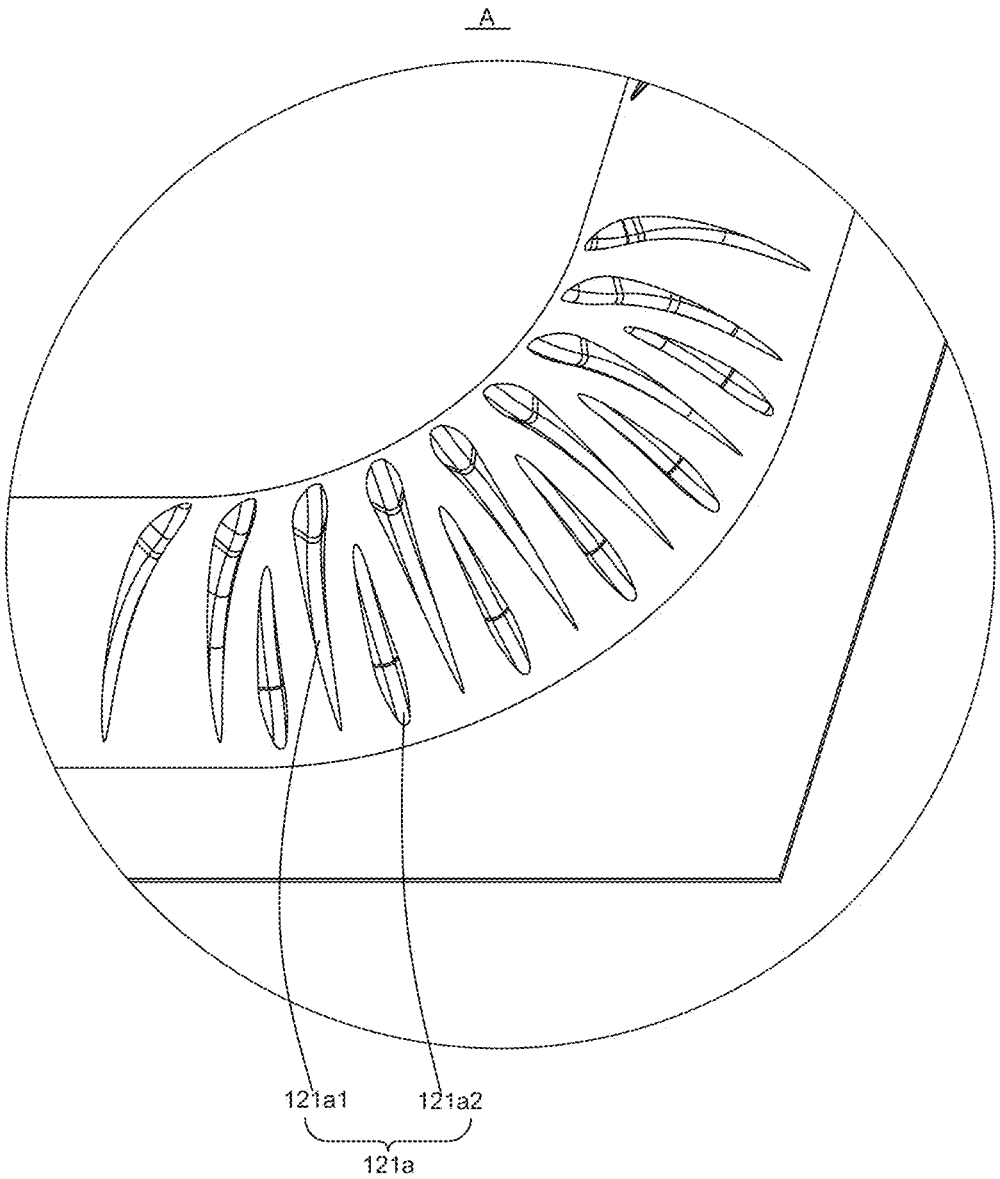
FIG. 2 is an enlarged view of Part A in FIG. 1.
Figure 3:
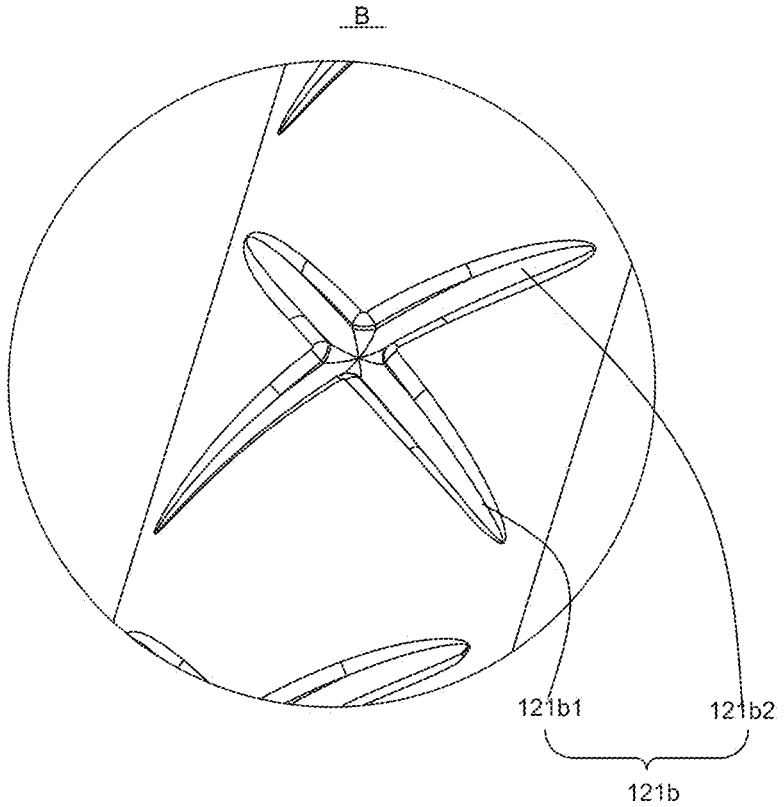
FIG. 3 is an enlarged view of Part B in FIG. 1.

As shown in FIGS. 1-3, a vibration membrane 100 in accordance with an exemplary embodiment of the present disclosure is herein disclosed. The vibration membrane 100 is mainly applied in the sound generating device of electronic equipment. The sound generating device typically comprises a magnetic circuit system and a vibration system, wherein the magnetic circuit system comprises a yoke and a magnet accommodated in the yoke for forming a magnetic gap between the yoke and the magnet; and the vibration system comprises a voice coil suspended in the magnetic gap and the membrane 100 which is connected with the voice coil and driven by the same to vibrate.

The vibration membrane 100 comprises a central dome part 110, a suspension part 120 surrounding the dome part 110 and a fixation part 122 extending outwards from the suspension part 120, where the suspension part 120 has an annular, protruding shape. Wherein the inside of the suspension part 120 refers to the side close to the dome part 110, and the outside of the suspension part 120 refers to the side away from the dome part 110.

The suspension part 120 comprises a pair of long-axis parts 123 parallel to a long axis of the vibration membrane, a pair of short-axis parts 124 parallel to a short axis of the vibration membrane, and a plurality of corner parts 125 connecting the long-axis parts 123 and the short-axis parts 124. The suspension part 120 is provided with a number of first reinforcing parts 121*a* and a number of second reinforcing parts 121*b*, the first reinforcing part 121*a* is located at the corner part 125, while the second reinforcing part 121*b* is located at the long-axis part 123 of the suspension part 120. The second reinforcing part 121*b* comprises a plurality of first master extension parts 121*b*1 and a plurality of first slave extension parts 121*b*2 crossing with the first master extension parts 121*b*1, which can effectively improve the strength of the vibration membrane 100. Especially when the suspension part of the vibration membrane 100 has a very long length along the long axis, the strength is significantly improved, and the membrane collapsing is reduced, accordingly, the life of the membrane is prolonged and the sound generating device with the membrane 100 has an excellent sound generating performance.

It should be noted that no limitation is made to the structures of the first reinforcing parts 121*a* and the second reinforcing parts 121*b*, for example, their structure may be a depression part sinking in the surface of the suspension part 120 or a protrusion part rising from the surface of the suspension part 120.

It should also be understood that the crossing of the first master extension part 121*b*1 and the first slave extension part 121*b*2 may be as follows: the first master extension part 121*b*1 and the first slave extension part 121*b*2 cross at a point from which both parts extend to two sides, i.e. to roughly form a X shape, or the first master extension part 121*b*1 and the first slave extension part 121*b*2 cross at a point from which the first master extension part 121*b*1 extends to two sides and the first slave extension part 121*b*2 extends to one side, i.e. to roughly form a Y shape, or the first master extension part 121*b*1 and the first slave extension part 121*b*2 cross at a point from which the first master extension part 121*b*1 and the first slave extension part 121*b*2 extend to one side, i.e. to roughly form a V shape. Of course, the first master extension part 121*b*1 and the first slave extension part 121*b*2 may be configured to have other shapes, etc.

The first reinforcing part 121*a* is located at the corner parts 125 of the suspension part 120, and the first reinforcing part 121*a* extends from the outside of the corner part 125 to the inside of the corner part 125.

In the vibration membrane 100 of the structure according to the embodiment, the provision of the first reinforcing parts 121*a* at the corner part 125 of the suspension part 120 can effectively improve the strength of the membrane 100 at the corner part 121*c* and reduce the membrane collapsing.

The first reinforcing parts 121*a* are alternately provided spaced apart at the corner parts 125, and the second reinforcing parts 121*b* are provided spaced apart along the extension direction of the long-axis parts 123.

In the membrane 100 of the structure according to the embodiment, the provision of the multiple first reinforcing parts 121*a* at the corner part 125 of the suspension part 120 and the provision of the multiple second reinforcing parts 121*b* provided spaced apart along the extension part of the long-axis part 123 can effectively improve the strength of the membrane 100 at the corner part 125 and the long-axis sides 123 as well as reduce the membrane collapsing.

The first reinforcing part 121*a* comprises second master extension parts 121*a*1 and second slave extension parts 121*a*2 alternately provided spaced apart, the second master extension parts 121*a*1 extend from the inside of the annular, protruding part 121 to the outside, and the second master extension parts 121*a*1 decrease progressively in turn in width from the inside of the annular, protruding part 121 to the outside; the second slave extension parts 121*a*2 extend from the outside of the annular, protruding part 121 to the inside, and the second slave extension parts 121*a*2 decrease progressively in turn in width from the outside of the annular, protruding part 121 to the inside.

In the vibration membrane 100 of the structure according to the embodiment, the first reinforcing part 121*a* comprises second master extension parts 121*a*1 and second slave extension parts 121*a*2 provided spaced apart, which can further effectively improve the strength of the membrane 100 at the corner 121*c* and reduce the membrane collapsing; besides, the membrane 100 of the structure can be also easily fabricated and requires less cost.

Specifically, the structure of both the first reinforcing parts 121*a* and the second reinforcing parts 121*b* is a depression part sinking in the surface of the suspension part 120.

Of course, another structure of both the first reinforcing parts 121*a* and the second reinforcing parts 121*b* may also be a protrusion part rising from the surface of the suspension part 120.

In the vibration membrane 100 of both structures described above, the strength of the membrane at the corner part 125 and the long-axis parts 123 can be effectively improved and the membrane collapsing is reduced. Taking the convenience of fabricating processes into consideration, the first reinforcing parts 121*a* and the second reinforcing parts 121*b* of the first structure are preferable, i.e. both the reinforcing parts are depression parts sinking in the surface of the suspension part 120.

In order to further improve the strength of the vibration membrane, the corner parts 125 of the suspension part 120 are rounded off.

A sounding device is provided according to the second aspect of the present utility model (not shown in figures). The sounding device comprises a magnetic circuit system (not shown in figures), a vibration system (not shown in figures) and a frame accommodating the magnetic circuit system and the vibration system (not shown in figures), wherein the vibration system includes the vibration membrane 100 described above.

The sounding device of the structure according to the embodiment includes the membrane 100 described above. The membrane 100 of such a structure has improved strength and does not collapse easily, so the life of the sounding device is prolonged and its vibration effect is improved.

An electronic equipment (not shown in figures) is provided according to the third aspect of the present utility model, and the electronic equipment comprises the sounding device described above.

The electronic equipment of the structure according to the embodiment has the sounding device described above which has the membrane 100 described above, the vibration effect of the electronic equipment is effectively improved and the life of the product is prolonged.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A vibration membrane comprising:

a central dome part;

a suspension part surrounding the dome part, the suspension part including a pair of long-axis parts parallel to a long axis of the vibration membrane, a pair of short-axis parts parallel to a short axis of the vibration membrane, and a plurality of corner parts connecting the long-axis parts with the short-axis parts;

a plurality of first reinforcing parts located on the corner parts;

a plurality of second reinforcing parts located on the long-axis parts; wherein each of the second reinforcing part comprises a first master extension part and a first slave extension part crossing with the first master extension part.

2. The vibration membrane as described in claim 1, wherein the first reinforcing part extends from an outside of the corner part to an inside of the corner part.

3. The vibration membrane as described in claim 1, wherein the first reinforcing parts are provided spaced apart, and the second reinforcing parts are provided spaced apart along the long-axis parts.

4. The vibration membrane as described in claim 3, wherein the first reinforcing part comprises a plurality of second master extension parts and a plurality of second slave extension parts alternately provided spaced apart, the second master extension parts decrease progressively in turn in width from outside toward inside; the second slave extension parts extend from the outside toward the inside, and the second slave extension parts decrease progressively in turn in width from the outside toward the inside.

5. The vibration membrane as described in claim 1, wherein the first reinforcing parts and the second reinforcing parts are depression parts sinking in a surface of the suspension part.

6. The vibration membrane as described in claim 1, wherein the first reinforcing parts and the second reinforcing parts are protrusions rising from a surface of the suspension part.

7. The vibration membrane as described in claim 1, wherein the corner parts of the suspension part are rounded off.

* * * * *